United States Patent [19]

Robertson et al.

[11] 4,282,044

[45] Aug. 4, 1981

[54] METHOD OF RECYCLING ALUMINUM SCRAP INTO SHEET MATERIAL FOR ALUMINUM CONTAINERS

[75] Inventors: King G. Robertson; Donald C. McAuliffe, both of Golden, Colo.

[73] Assignee: Coors Container Company, Golden, Colo.

[21] Appl. No.: 931,041

[22] Filed: Aug. 4, 1978

[51] Int. Cl.[3] ..... C22F 1/04

[52] U.S. Cl. ..... 148/2; 29/527.7; 148/11.5 A; 148/12.7 A

[58] Field of Search ..... 148/2, 3, 11.5 A, 12.7 A; 29/527.7

[56] References Cited

U.S. PATENT DOCUMENTS

| | | | |
|---|---|---|---|
| 3,787,248 | 1/1974 | Setzer et al. | 148/11.5 A |
| 3,802,931 | 4/1974 | Bylund | 148/11.5 A |
| 3,900,313 | 8/1975 | Martin | 75/68 R |
| 3,930,895 | 1/1976 | Moser et al. | 148/11.5 A |

*Primary Examiner*—R. Dean

*Attorney, Agent, or Firm*—Bruce G. Klaas; Richard D. Law; Dennis K. Shelton

[57] ABSTRACT

A composition and method whereby aluminum scrap, including consumer scrap, is recycled into aluminum sheet and aluminum containers. Aluminum scrap is melted in a heated furnace to form a melt composition. The melt is adjusted to form the present composition, consisting essentially of silicon, 0.1–1.0%; iron 0.1–0.9%; manganese 0.4–1.0%; magnesium 1.3–2.5%; copper 0.05–0.4%; and titanium, 0–0.2%, the balance being essentially aluminum. Aluminum scrap comprising consumer scrap, plant scrap, and can making scrap is heated to form the melt composition, which requires a minimum amount of adjustment to arrive at the present alloy composition. The composition is then cast and fabricated into sheet having strength and formability properties making it suitable for container manufacture. Container manufacture according to the process and composition of the present invention comprises drawn-and-ironed can body manufacture and easy-opening end manufacture. Sheet fabrication according to the present invention comprises direct chill casting, scalping, preheating, hot breakdown rolling, continuous hot rolling, annealing, cold rolling and shearing. Sheet manufacture may also comprise continuous strip casting and solution heat treatment.

17 Claims, 3 Drawing Figures

METHOD OF RECYCLING ALUMINUM SCRAP INTO SHEET MATERIAL FOR ALUMINUM CONTAINERS

CROSS REFERENCE TO RELATED APPLICATIONS

Reference should be had to "An Aluminum Alloy Composition for the Manufacture of Container Components from Scrap Aluminum" by King Robertson, Ser. No. 931,036 "Fabrication of Aluminum Alloy Sheet from Scrap Aluminum for Container Components" by King Robertson and Donald McAuliffe Ser. No. 931,040 and "Continuous Strip Casting of Aluminum Alloy from Scrap Aluminum for Container Components" by Ivan Gyoengyoes, Heinz Bichsel and Kirt Buxmann Ser. No. 931,039 all filed concurrently herewith.

BACKGROUND OF INVENTION

In general, the present invention relates to aluminum sheet metal materials for metallic containers and components thereof, compositions thereof, and methods and processes of manufacture thereof enabling and facilitating the manufacture of containers and the like by use of materials of used empty containers and scrap materials as part of a recycling system.

At the present time, substantial efforts are being made to conserve energy and material resources as well as to eliminate waste and litter problems which have long plagued the beverage industry in particular. The present invention is part of an attempt to develop a total recycle program in the aluminum can industry including: (1) the collection and return of aluminum beverage cans after use by the consumer; and (2) the re-use of the aluminum material of used cans to manufacture new cans.

Thus, the primary purpose of the present invention is to provide an economically feasible recycle program for aluminum beverage cans. The primary purpose has been fulfilled by development of a new aluminum alloy composition enabling the manufacture of all components of aluminum cans from a single alloy composition by new methods and processes which provide single alloy composition sheet stock suitable for use with conventional aluminum can making equipment, methods and processes. As a result of the use of the new composition and the new methods and processes, an aluminum can having all components made from sheet stock of the same alloy composition may be produced by high speed mass production techniques whereas, in the past, different components of commercially acceptable aluminum cans have been made from different alloy compositions such as shown in the following Table I:

less a range is shown. The AA designation and number refer to the registration of the alloy with the Aluminum Association. CS42 refers to an Alcoa alloy developed for use in can ends and tabs and further described below.

Aluminum food and beverage containers have been successfully manufactured since the early 1960s. As used herein, the term "container" refers to any aluminum sheet product formed to contain a product, including carbonated beverage cans, vacuum cans, trays, dishes, and container components such as fully removable ends and ring tab ends. The term "can" refers to a fully enclosed container designed to withstand internal and external pressure, such as vacuum and beverage cans. Initially only can ends were formed of aluminum and were termed "soft tops". These tops had no easy opening features and were manufactured from Aluminum Association (AA alloy) 5086. The introduction of easy opening ends such as the "ring pull" end required the use of more formable alloys such as AA 5182, 5082 and 5052. The commonly used 5082 and 5182 are high in magnesium content (4.0–5.0%) and are designed to be relatively strong as compared to those alloys used in can bodies. 5052 is primarily used in shallow drawn and drawn and redrawn non-pressurized containers, as it lacks sufficient strength for most can applications.

Shortly after the introduction of aluminum can ends, aluminum can bodies were introduced. Aluminum can bodies were initially made as parts of three piece cans, as "tin" cans had traditionally been made. Three piece cans consist of two ends and a body which is formed into a cylindrical shape and seamed. Two piece cans have since been developed and are gradually replacing three piece cans in beverage applications. Two piece cans consist of a top end and a seamless body with an integral bottom end. Two piece can bodies are formed by a number of processes, including shallow drawing, drawing and redrawing, and drawing-and-ironing.

An apparatus for making drawn-and-ironed cans is described in U.S. Pat. No. 3,402,591, to which attention is directed for a further understanding of the can body manufacturing aspect of the present invention. In drawing and ironing, the body is made from a circular sheet, or blank, which is first drawn into a cup. The side walls are then extended and thinned by passing the cup through a series of dies with diminishing bores. The dies produce an ironing effect which lengthens the side walls and permits the manufacture of can bodies having sidewalls thinner than their bottoms. AA 3004 is typically used in the formation of two piece can bodies, as it provides adequate formability, strength, and tool wear characteristics for the draw-and-iron process. These properties are a function of the low Mg (0.8–1.3%) and Mn (1.0–1.5%) content of the alloy.

TABLE I

| Alloy | Silicon | Iron | Copper | Manganese | Magnesium | Chromium | Zinc | Titanium | Others Each | Others Total |
|---|---|---|---|---|---|---|---|---|---|---|
| AA 3003 | 0.6 | 0.7 | 0.05–0.2 | 1.0–1.5 | — | — | 0.10 | — | 0.05 | 0.15 |
| AA 3004 | 0.30 | 0.70 | 0.25 | 1.0–1.5 | 0.8–1.3 | — | 0.25 | — | 0.05 | 0.15 |
| AA 5182 | 0.20 | 0.35 | 0.15 | 0.20–0.50 | 4.0–5.0 | 0.10 | 0.25 | 0.10 | 0.05 | 0.15 |
| AA 5082 | 0.20 | 0.35 | 0.15 | 0.15 | 4.0–5.0 | 0.15 | 0.25 | 0.10 | 0.05 | 0.15 |
| AA 5052 | 0.45 | Si + Fe | 0.10 | 0.10 | 2.2–2.8 | 0.15–0.35 | 0.10 | — | 0.05 | 0.15 |
| CS42 | 0.20 | 0.35 | 0.15 | 0.20–0.50 | 3.0–4.0 | 0.10 | 0.25 | 0.10 | 0.05 | 0.15 |

The numerical amounts shown represent weight percentages. The ranges shown are inclusive. These conventions are carried throughout the present specification. All percentages shown above are maximums un- The presently used 3004 is disadvantageous in that it requires a high ingot preheat or homogenization temperature for a long time in order to achieve the desired final properties. Conventional ingot preheating is one of the most costly factors in producing finished sheet. In addition, 3004 has a relatively slow casting rate and a tendency to form large primary segregation when improperly cast.

Other alloys have been previously considered for use in can bodies, such as AA 3003. This alloy meets all forming requirements for the draw-and-iron process, but was abandoned because of low strength at economical gauges.

The conventional alloys described above for can ends and can bodies differ significantly in composition. In the manufactured can, the end and the body are essentially inseparable so that an economical recycle system requires use of the entire can. Therefore, in recycling cans, the melt composition differs significantly from the compositions of both conventional can end alloys and conventional can body alloys. If it is desired to obtain the original compositions, significant amounts of primary, or pure, aluminum must be added to obtain a conventional can body alloy composition, and even greater amounts of primary aluminum must be added to obtain a conventional can end alloy composition.

Accordingly, it would be advantageous to employ an aluminum alloy of the same composition in both can ends and can bodies so that the remelt from those cans would not have to be adjusted. This advantage was recognized and described by Setzer et al. In U.S. Pat. No. 3,787,248, which proposes a can end and body which are both made from a 3004 type alloy which has been heat treated to provide the formability necessary for its use in can ends. The fabrication process proposed by Setzer et al., however, includes a high temperature holding step after cold rolling. Furthermore, the compositions proposed by Setzer et al. would produce a melt composition significantly different from a melt of conventional two alloy cans.

SUMMARY OF THE INVENTION

The present invention provides a single alloy composition for both can body members and end members, sheet fabrication processes, and container manufacture processes whereby recycled scrap may be economically converted to single alloy sheet materials for forming all container components. By melting of all aluminum scrap, including used and defective cans, can making scrap and plant scrap, an initial melt composition is formed which then may be readily adjusted to form the single alloy composition of the present process. The single alloy composition consists essentially of silicon, 0.1–1.0%; iron 0.1–0.9%; manganese 0.4–1.0%; magnesium 1.3–2.5%; chromium 0–0.1%; zinc 0–0.25%, copper 0.05–0.4% and titanium, 0–0.2%, the balance being essentially aluminum. The composition requires a minimum addition of pure aluminum to the initial melt composition due to the quantitative and qualitative makeup of the present alloy composition. The present composition is also unaffected by a wide range of impurities which may be expected from consumer scrap. The present composition is cast and fabricated into single alloy sheets having strength and formability properties making it suitable for container body, end, and easy open device manufacture by conventional equipment and processes. In general, the methods and processes of the present invention comprise: (1) melting of scrap cans in a heated furnace; (2) adjustment of the melt composition to form the composition of the present invention; (3) treating the melt composition to remove impurities; (4) casting of the present composition; (5) fabricating the alloy composition into sheet forms, and (6) manufacturing of the various can components from the sheets. The casting and fabricating steps of the present invention may be carried out with conventional direct chill casting or with continuous strip casting.

The use of the alloy composition of the present invention provides several advantages in the manufacture of the sheet materials and in the manufacture of the can components from those sheet materials, including:

(1) improved castability and ingot treatment as compared to conventional can body alloys, including the reduction of preheat and scalping requirements;

(2) lower energy requirements in hot and cold rolling operations and improved thermal response as compared to conventional can end alloys;

(3) improved material handling requirements in a rolling mill due to a number of fabrication steps which are identical for can end stock and can body stock;

(4) reduced separation of alloys for inventory and handling, including alloy makeup and casting procedures resulting from fabricating can end stock and can body stock from a single composition; and (5) the subsequent manufacture of all components of the can from sheet materials having a single alloy composition.

DESCRIPTION OF THE PREFERRED EMBODIMENT

Figure 1:
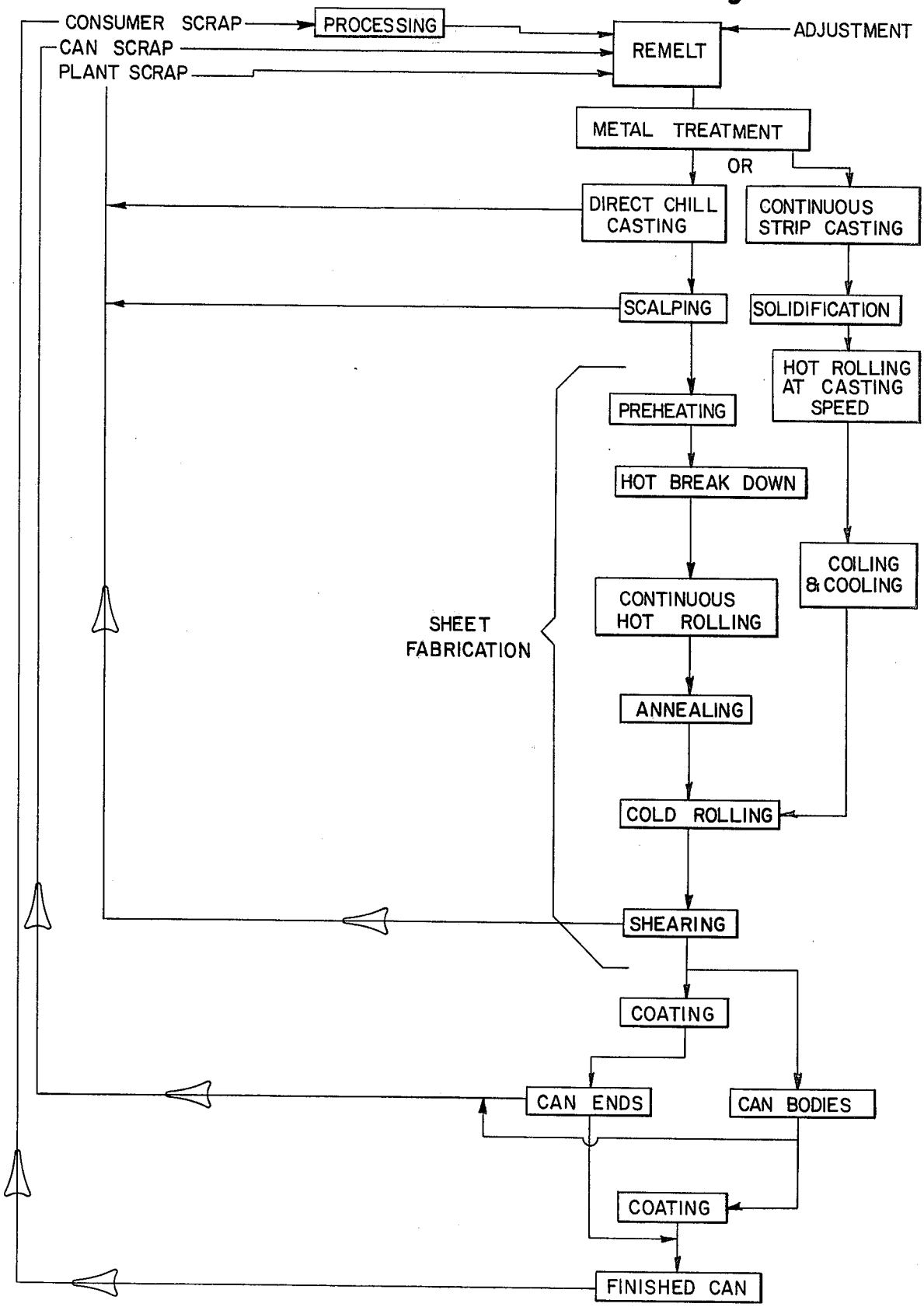
FIG. 1 is a flow chart of the processes of an embodiment of the present invention utilizing direct chill casting.

Referring now to FIG. 1, the processes of melting various types of scrap, adjusting the melt to a desired composition, casting the melt, fabricating alloy sheet, and manufacturing container products from the sheet may be seen to comprise a closed loop system wherein scrap generated by the manufacturing process is recycled to provide raw material for the process. The scrap used in the present invention comprises plant scrap, can scrap and consumer scrap.

PROCESSING CONSUMER SCRAP

Consumer scrap refers to aluminum alloy products, especially cans, which have been decorated, coated, or otherwise contaminated, sold, and used.

The process of the present invention is particularly adapted for use with scrap aluminum cans. In the preferred practice, cans are recovered in their cleanest form, free from dirt, plastic, glass, and other foreign contamination. The can bodies of conventional aluminum cans are inseparable from the can ends. Therefore during recovery of scrap cans, the whole cans are crushed, flattened, baled, or otherwise compacted. The cans are then reduced to shreds by a conventional grinder, hammer mill, contra-rotating knives, etc., to reduce the cans to small particles, preferably into a loose, open form of approximately 2.5–4.0 cm nominal diameter. The shredded aluminum scrap is subjected to magnetic separation to remove iron and steel contaminants, and to gravity or cyclone separation to remove paper and lightweight contaminants. The cleaned scrap is then introduced into a delacquering furnace. A suitable delacquering furnace is a rotary kiln, wherein scrap is transported, with hot air, through a rotating tunnel. Alternatively, a delacquering furnace may be employed which contains a stainless steel belt which holds a bed approximately 15–25 cm deep of shredded scrap. Heated air is blown through the belt and scrap to burn organics such as plastic coatings used on the surfaces of food and beverage containers, as well as painted or printed labels containing pigments such as titanium (IV) oxide.

The preferred temperature of the furnace is such as to raise the temperature of the scrap to a pyrolysis temperature, typically 480°–540° C., sufficient to pyrolyze any organic coating materials but not to oxidize the metal scrap.

SCRAP MELTING

A. Scrap Input

The scrap used in the present invention comprises aluminum alloy material such as plant scrap, can scrap and consumer scrap processed as described above. A large portion of consumer scrap consists of aluminum cans, which typically contain 25% by weight AA 5182 can ends and 75% by weight AA 3004 can bodies. The compositions of these alloys and the composition obtained from remelting can scrap of these alloys are further described in Table II hereinbelow. Plant scrap comprises ingot scalpings, rolled strip slicings, and other alloy trim produced in a rolling mill operation. The initial melt composition obtained from a typical plant scrap based on 88% 3004 and 12% CS 42, which is another high magnesium alloy used in producing can ends, is further described in Table III hereinbelow.

The scrap used in the present invention may also include can scrap from the manufacture of containers and container components such as can ends and can bodies. Can scrap includes scrap produced by earing and galling during can manufacture. The scrap used in the present invention may also include other aluminum material rich in alloy hardeners, and is also intended to include consumer, plant, and can scrap produced from the alloy of the present invention.

B. Alloy Preparation

The scrap to be recycled is charged into a furnace as is known in the art and described, for example, in U.S. Pat. No. 969,253. The scrap is melted in a furnace to form a melt composition. The initial melt will vary in composition according to the compositions and amounts of the various types of scrap charged in the furnace. In the process of the present invention, the initial melt is adjusted to bring the composition within the following ranges:

| | Broad Range: | Preferred Range: |
|---|---|---|
| Magnesium | 1.3–2.5 | 1.6–2.0 |
| Manganese | 0.4–1.0 | 0.6–0.8 |
| Iron | 0.1–0.9 | 0.3–0.7 |
| Silicon | 0.1–1.0 | .15–.40 |
| Copper | .05–0.4 | 0.3–0.4 |
| Titanium | 0–0.2 | 0–0.15 |

The above stated values represent the broad and preferred composition ranges of the alloy of the present invention. The composition of the present alloy may vary within the ranges stated but the ranges themselves are critical, especially those of the primary alloying elements magnesium and manganese. Magnesium and manganese together exhibit a solid solution strengthening effect in the present alloy. Therefore, it is essential to provide these elements in amounts within the stated ranges as well as in a ratio of magnesium to manganese of between 1.4:1 and 4.4:1, and in a total concentration of magnesium and manganese of 2.0–3.3%. Other trace elements in the form of impurities may be expected from recycling and are tolerable in the present composition up to certain limits. These impurities include chromium up to 0.1%, zinc up to 0.25%, and others up to 0.05% each, and up to 0.2% total.

Copper and iron are included in the present composition due to their inevitable presence in consumer scrap. The presence of copper between 0.05 and 0.2% also enhances the low earing properties and adds to the strength of the present alloy.

In order to arrive within the stated ranges or at the preferred composition of the present alloy, it may be necessary to adjust the melt. This may be carried out by adding magnesium or manganese, or by adding unalloyed aluminum to the melt composition to dilute the excess alloying elements. The total energy needed to produce unalloyed primary aluminum from its ore in refining and smelting is approximately twenty times the energy required for melting scrap aluminum. Considerable energy and cost can therefore be saved by minimizing the amount of primary aluminum needed to produce a desired alloy. If excess magnesium is present, the amount of magnesium in the melt may also be reduced by fluxing the molten alloy with chlorine gas to form insoluble magnesium chloride which is removed with the dross. This process, however, is not desirable due to the loss of magnesium from the alloy, and because of the environmental and occupational hazards associated with chlorine gas. Adjusting of the melt may also be carried out by the addition of lower alloy aluminum using the appropriate ratios to dilute excess elements.

Table II below shows the compositions of AA 3004, 5182 and the stoichiometric melt composition obtained from melting typical consumer scrap composed of cans made from these alloys:

TABLE II

| ALLOY (TYPICAL COMPOSITION) | | | | PRIME FACTOR (%) | | |
|---|---|---|---|---|---|---|
| ALLOY ELEMENT | 3004 | 5182 | MELT | TO 3004 | TO 5182 | TO NOMINAL |
| Magnesium | 0.9 | 4.5 | 1.5 | 40 | — | — |
| Manganese | 1.0 | 0.25 | .8 | — | 70 | 18 |
| Iron | 0.45 | 0.25 | .4 | — | 39 | 3 |
| Silicon | 0.2 | 0.12 | .2 | — | 33 | — |
| Titanium | 0.04 | 0.05 | .04 | — | — | — |
| Copper | .18 | 0.08 | .1 | — | 27 | — |

The figure of 1.5% magnesium in the column headed "MELT" is based on an assumed 0.3% loss in the remelt due to magnesium oxidation in the melting process.

The portion of the table headed "Prime Factor" shows the percentage amounts of primary, or pure, aluminum which must be added to the melt to bring each element of the melt to the nominal composition of 3004, 5182, or the present alloy. The nominal composition of the present alloy, as used in the specification and examples, has the following composition: magnesium, 1.8%; manganese, 0.7%; iron, 0.45%; silicon, 0.25%; copper, 0.2%; and titanium, 0.05%. Since the stated amounts of alloying elements in 3004 and 5182 other than magnesium or manganese are maximums, the largest prime factor shown for each alloy is controlling.

Thus, Table II shows that an amount of pure aluminum equal to 40% of the weight of the can scrap melt composition must be added if one were to reduce the amount of magnesium in the melt to the 0.9% typical magnesium content of 3004. Similarly, an amount of pure aluminum equal to 70% of the melt weight must be added if one were to reduce the amount of manganese in the melt to the typical 0.25% 5182 content. On the other hand, only 18% pure aluminum is necessary to bring the melt to the nominal manganese content of the alloy of the present invention.

Table III illustrates the same point with regard to plant scrap comprising 88% 3004 and 12% CS42:

TABLE III

| | TYPICAL COMPOSITION % | | | PRIME FACTOR % | | |
|---|---|---|---|---|---|---|
| | 3004 | CS42 | MELT | TO 3004 | TO CS42 | TO NOMINAL |
| Magnesium | 0.9 | 3.5 | 1.21 | 26 | — | — |
| Manganese | 1.0 | .25 | .91 | — | 73 | 23 |
| Iron | 0.45 | .25 | .43 | — | 42 | 5 |
| Silicon | 0.2 | .12 | .19 | — | 37 | — |
| Titanium | .04 | .05 | .04 | — | — | — |
| Copper | .18 | .08 | .17 | — | 53 | — |

26% Prime aluminum would be necessary to bring the above melt to a 0.9% magnesium 3004 composition, and 73% prime aluminum would be necessary to bring the melt to a 0.25% manganese CS42 composition, while only 23% prime aluminum would be necessary to bring the melt to the nominal manganese content of the present alloy.

Tables II and III demonstrate that the composition and method of the present invention permit an adjustment of less than 25% unalloyed aluminum, which is less than the adjustment required to arrive at any of the known container alloys. The Tables also demonstrate that the type of scrap in the melt will affect the amount of prime metal needed to bring the melt to a desirable composition. The present composition can also be arrived at with the use of 100% scrap, depending on the type of scrap which is added to the melt system. For example, a typical can plant may require 83% can body stock (3004) and 17% can end stock (CS42). Of these stocks, byproduct scrap is produced as 24.9% can scrap and 2.7% end scrap for a net 27.6% plant scrap to be melted. Plant scrap and consumer scrap in the form of returned consumer cans may be added to the melt. Assuming 5% melt loss in plant scrap and 8% melt loss in returned consumer cans, a return of all cans produced at that can plant will require an adjustment of only 7.2% prime aluminum in the melt to arrive at the composition of the present alloy. This amount can be further reduced through the use of other scrap alloys in the melt, including the use of scrap of the present alloy.

With the use of prior art alloy compositions, it has not been possible to reduce the amount of primary or unalloyed aluminum necessary to obtain a useful melt alloy composition from consumer scrap to below 40% of the charge in the melting furnace. The present invention permits the formulation of the present composition from at least 40% scrap over a wide range of proportions of can scrap, plant scrap and consumer scrap.

The present alloy provides a number of advantages which are derived in obtaining the alloy composition from the melt. A prime advantage is, as stated, the fact that the present alloy is readily obtainable from recycling presently existing aluminum scrap. As a further advantage, the present alloy exhibits a high tolerance for silicon, iron, copper and other elements which are regarded as undesirable impurities in conventional alloys but which are inevitably present in consumer scrap. For example, a relatively high concentration of titanium may be tolerated, which is important from a recycling standpoint because a great deal of consumer scrap contains titanium oxide which is reduced to titanium during melting and dissolved in the molten alloy. A high tolerance for titanium is also important because the titanium level will build up as scrap is remelted through successive cycles. A range from 0.15% to 0.20% may be expected and may be tolerated in the present alloy.

As a further example, the alloy may contain a relatively high level of silicon from sand or dirt in the scrap. The present alloy tolerates this level and furthermore, at silicon levels above 0.45, using the range of elements given above, provides the additional advantage of being heat treatable. Heat treatment refers to the process wherein an alloy is heated to a temperature that is high enough to put the soluble alloying elements or compounds ($Mg_2Si$) into solid solution, typically 510°–610° C. The alloy is then quenched to keep these elements in supersaturated solid solution. The alloy is then age hardened, either at room temperature or at an elevated temperature, during which time a precipitate forms to harden the alloy. The age hardening may take place at temperatures currently used to cure polymeric coatings in aluminum containers, as described below. Accordingly, when using a heat treatable alloy in manufacturing operations involving a polymer curing step, the alloy may be age hardened simultaneously with the curing. This permits the use of fabrication processes which yield sheets with less strength than would otherwise be required in the as-rolled sheet.

METAL TREATMENT

After the alloy in the melting furnace is adjusted to the desired composition, the molten alloy is treated to remove materials such as dissolved hydrogen and non-metallic inclusions which would impair the casting of the alloy and the quality of the finished sheet. A gaseous mixture comprising chlorine and an inert gas such as nitrogen or argon is passed through at least one carbon tube disposed in the bottom of the furnace to permit the gas to bubble through the molten alloy. The gaseous mixture is bubbled through the molten alloy for approximately 20–40 minutes and produces dross which floats to the top of the molten alloy and is skimmed off by any suitable method. The lower magnesium concentration of the present alloy results in less dross and magnesium burn-off than 5082, 5182 and other conventional end alloys. The skimmed alloy is then filtered through a bed of an inert, particulate, refactory medium, such as aluminum oxide, to further remove non-metallic inclusions. In the filter, a gaseous mixture, as described above, is again bubbled through the molten alloy countercurrent to the alloy flow for further degassing.

CONVENTIONAL CASTING

The molten alloy then may be cast by the direct chill process to produce an ingot or it may be cast by the continuous strip casting method described below. The direct chill casting process is well known and need not be described in detail. Basically, the molten metal is poured within a predetermined temperature range, 700°-750° C., for the present alloy, into a mold. The mold has fixed side walls and a movable bottom in the case of a vertical mold, or fixed walls and a movable side plug in the case of a horizontal mold.

The metal which has been poured into the mold solidifies, and the solid portion is slid from the mold, and through the fixed walls, as the movable portion of the mold is withdrawn. The fixed walls are internally cooled and lubricated to facilitate passage therethrough of solidified metal. Metal leaving the mold is cooled with a direct spray of water onto the metal, or ingot. For sheet ingot, molds are made in a wide variety of sizes depending on handling equipment and other factors. For optimum casting, the ingot leaving the mold is usually about twice as wide as it is thick.

An alloy having a composition according to the present invention may be cast in a given sheet-type mold at rates in excess of 110 kg per minute, compared to a maximum rate of 110 kg per minute for 3004 alloy. The present alloy may be cast more rapidly due to its finer grain size, closer dendrite spacing, and smaller primary constituent ($(FeMn)Al_6$) size. These qualities also produce less cracking during casting with a resultant reduction in plant scrap from scrapped ingots.

The cast ingots are then scalped to remove non-uniformities in the composition from the outer, rolling surfaces of the ingot. Scalping refers to a knifing treatment of the rolling surfaces of the ingot, and the knifed or shaved outer portions of the ingot are one source of plant scrap, as shown in FIG. 1. Less scalping is required for the ingots formed of the present composition that is required for ingots of 3004. Scalping in the present alloy is approximately one-half inch per side, for a 25% reduction in scalping over a typical 3004 process.

SHEET FABRICATION FROM CAST INGOTS

The scalped ingot is then preheated to 550°-600° C., preferably 570° C., for a four to six hour soak time. Soak time refers to a holding time within a given temperature range, excluding heating and cooling times. This compares favorably to a typical four to six hour preheat treatment of 565°-610° C. for 3004. A lower preheat temperature is possible because of the lower manganese and higher magnesium content of the present alloy compared to 3004.

The preheat temperature is selected to be below the non-equilibrium solidus of the alloy, that is, below the lowest temperature of incipient melting of any phase or component present. Molecular mobility at the soak temperature homogenizes the composition of the ingot after the segregation which occurs in casting, redistributes the alloying elements, and reduces grain boundary concentrations. In addition, certain solid state reactions occur in manganese, silicon and iron containing alloys in which some of the phase $(FeMn)Al_6$ is transformed to the form alpha Al(FeSiMn). The present alloy exhibits a greater alpha transformation at a given temperature than 3004, which results in less tool galling during the draw-and-iron can body manufacturing described below. The present alloy is fabricated to achieve a minimum 25% alpha transformation, typically 30-50% or more. Alpha transformation may be brought about during the preheat treatment, or during the below described steps of hot rolling, carried out at a high temperature to a high reduction, or during a high temperature annealing step.

After preheating, the ingot is cooled to an initial hot rolling temperature of 450°-510° C. and subjected to an initial hot rolling step termed a hot breakdown. The ingot does not require a slow cool, but may be air cooled in still air at ambient temperature. The initial hot rolling temperature, while not critical, is significantly lower than that used for 5182 (480°-525° C.). In hot breakdown, the ingot is reduced to a thin slab, typically 19 mm thick, from a 47.6 cm (19 in.) scalped ingot, for a 96% reduction. Hot breakdown reduction should be between 40% and 96% and serves to form the alloy into a shape suitable for further hot rolling. Hot breakdown is suitably accomplished in multiple passes through a reversing mill, as is known in the art.

After hot breakdown, the slab is immediately continuously hot rolled on a multistand hot mill to a reduction of 70-96%, preferably about 85%, for a reduction from 19 mm to 3.0 mm. Lubricants, as are known in the art, are used during hot rolling to prevent transfer of metal from the slab to the work rolls and to cool the mill rolls. The strip thus formed is at a cold rolling gauge which is selected to give the finish gauge after appropriate cold rolling. The present alloy is considerably softer than 5182 and requires less energy for reduction in both hot and cold working, and is less subject to edge cracking. The hot rolled strip is then coiled at a finish temperature, which is preferably 300° C., but may be lower depending on the capability of the particular hot mill employed.

The coiled strip is then annealed as required for further cold rolling. Annealing should be carried out at 315°-400° C., preferably at about 345° C., for a 2-4 hour soak time. In hot mills which are capable of providing a finish temperature sufficient to avoid cold working (i.e. about 315° C.), annealing may be omitted. Annealing is defined as a heat treatment above the recrystallization temperature of the alloy and designed to remove the preferred orientation of the grains of the alloy that result from hot working below the recrystallization temperature.

Annealing may also be carried out by flash annealing the strip in a continuous strip annealer wherein the strip is heated to 350°-500° C. for 3 to 90 seconds, preferably 3 to 30 seconds. Flash annealing provides better earing and improved elongation characteristics in sheet fabricated for use as can body stock. From the standpoint of necessary mill equipment, flash annealing is compatible with the solution heat treatment, described above, wherein the alloy is heated to 525°-550° C. and then rapidly quenched. Flash annealing is further described below, in connection with continuous strip casting.

After hot rolling and any necessary annealing, the strip is work hardened to final gauge.

Figure 2:
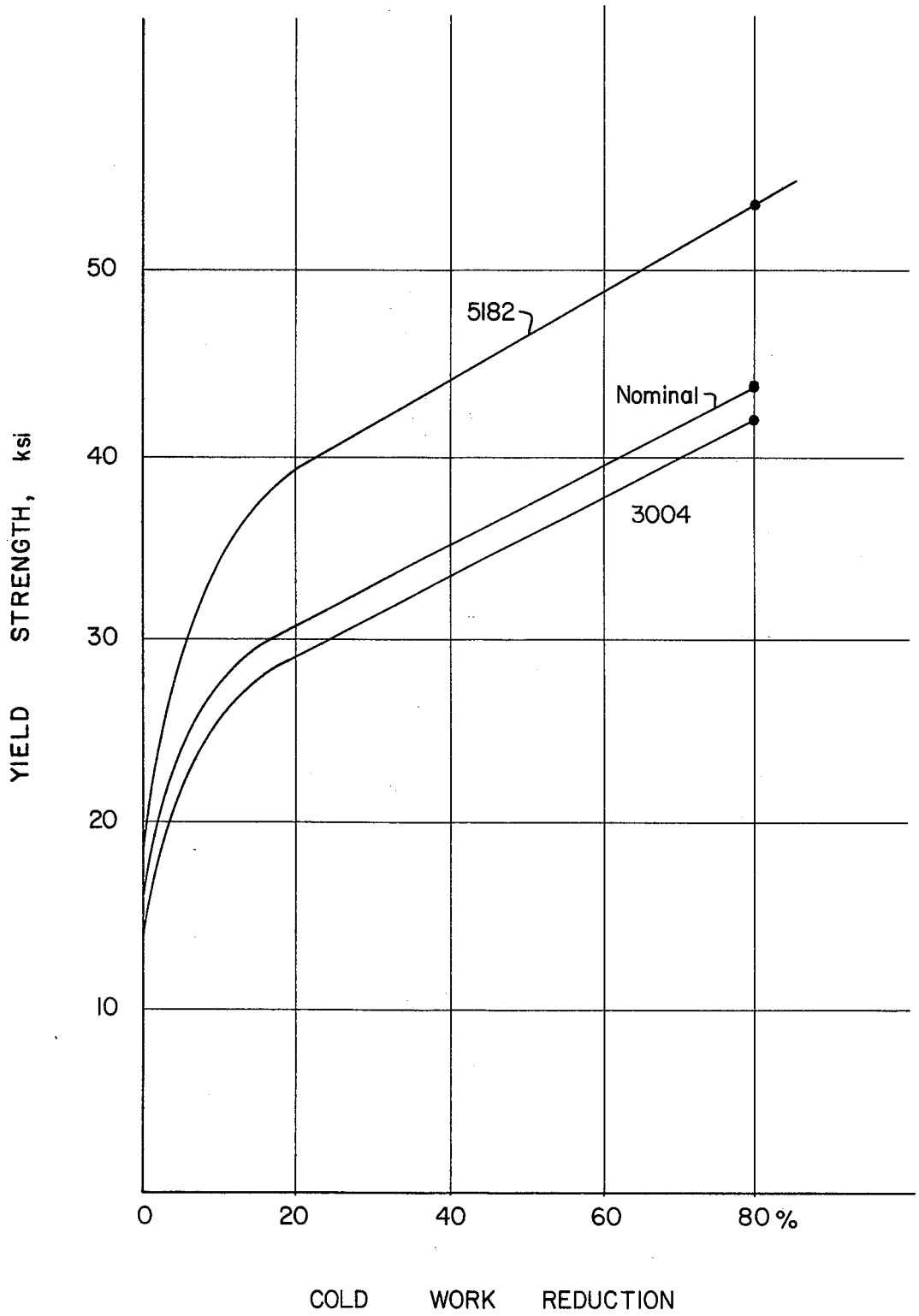
FIG. 2 is a graph showing the work hardening rate of the alloy used in the present invention.

Work hardening refers to the increase in strength of an alloy as a function of the amount of cold work reduction imposed on the metal. Compared to conventional can end stock, the alloy used in the present invention work hardens at a slower rate, as shown in FIG. 2. This means that fewer passes are necessary to achieve final gauge or that the same number of passes may be taken at a higher speed or greater width. Better flatness and less edge cracking also result from the present alloy than from conventional end stock. Moreover, the work hardening rate of the present alloy compares favorably with that of 3004 conventional body stock, which demonstrates that an excessive amount of cold working is not required to obtain sufficient alloy strength for can body stock.

The following cold rolling schedule is designed to produce can stock suitable for drawing-and-ironing into can bodies:

After annealing, the coiled strip is allowed to cool to below 200° C., typically to room temperature, and reduced from 3.0 mm to 0.34 mm, or 89%, preferably in one pass on one or more multiple stand tandem mills. Alternatively, the strip may be cold rolled through multiple passes on a single stand mill according to the following schedule: 3.0 mm to 1.30 mm to 0.66 mm to 0.34 mm. Annealing between cold rolling reductions is termed interannealing, and, if necessary, is carried out as described above. Interannealing may be necessary if cracking occurs in intermediate passes or to modify the final cold rolled properties of the strip. In the preferred single stand practice, an interanneal is carried out before the final pass. If interannealing is carried out, the final pass should preferably be between 40–60%. Interannealing in this practice is beneficial in reducing earing during drawing-and-ironing. A combination of single stand and multiple stand mills may also be used to perform the required cold working according to the work hardening rate shown in FIG. 2.

The sheet is then finished by shearing or slitting to the desired width. The sheet thus fabricated has a yield strength of 37–45 ksi (250–310 MPa), preferably 39–42 ksi (269–289 MPa); an ultimate tensile strength of 38–46 ksi, (262–317 MPa), preferably 40–44 ksi (276–303 MPa), and a percent elongation (ASTM) of 1–8%, preferably 2–3%.

The following cold rolling schedule is designed to produce end stock having sufficient flexibility and strength for forming can ends:

Sheet of 3.0 mm from hot rolling is cold rolled in one pass on a multiple stand tandem mill to 0.26 mm for a 91% reduction. Reduction should be from 60–95%. Reduction may alternatively be carried out in 4 passes on a single stand mill as follows: 3.0 mm to 1.30 mm to 0.66 mm to 0.34 mm to 0.26 mm. Interannealing is not necessary. The sheet is then finished by shearing or slitting to the desired width. The end stock cold rolling schedules yield the following mechanical properties (as rolled): yield strength 45–54 ksi (310–370 MPa), 47–51 ksi (320–360 MPa) preferred; 47–55 ksi (320–380 MPa) ultimate tensile strength, 49–52 ksi (340–350 MPa) preferred; and elongation (ASTM) 1–5%, 1–3% preferred.

The fabrication steps described above for can body stock and can end stock are intended and designed to produce adequately strain hardened sheet based on the consideration that can body stock should have a minimum yield strength of 35 ksi (240 MPa) while end stock should have a minimum yield strength of 43 ksi (300 MPa) (as rolled). It should be understood, however, that it is within the scope of the present invention to modify the described fabrication steps to produce other tempers, including fully annealed, strain hardened and partially annealed, strain hardened and stabilized, solution heat treated, aged and stress relieved. The present alloy, when fabricated to such other tempers may be applied to the manufacture of closures and containers including sardine cans, potted meat cans, snack food cans, process food cans, oil cans, film cans, and other containers and closures for both edible and non-edible containers. These containers may be manufactured using processes other than those described hereinafter, including shallow drawing, drawing and redrawing, and stamping.

CONTINUOUS STRIP CASTING

Continuous strip casting refers to the process wherein molten alloy is made to flow through a long narrow tip disposed between two closely spaced, driven rollers, belts, or loops of interconnected chill blocks. The metal solidifies in the moving mold space and is cast as a thin slab, rather than a thick ingot. Continuous strip casting may be regarded as replacing the steps of casting, preheating, and hot breakdwon associated with the above-described conventional casting process.

The continuous strip casting process of the present invention is preferably carried out with the casting apparatus described in U.S. Pat. Nos. 3,570,586, 3,709,281, 3,774,670, 3,747,666 and 3,835,917, all of which are hereby incorporated by reference.

The apparatus used to carry out the present strip casting process must be constructed to permit the solidifying strip emerging from the caster to pass through a high temperature holding zone, and thence, at casting speed, directly to a hot mill.

The present continuous strip casting process may be described in the following steps:

(a) continuously casting in a moving strip the alloy composition;

(b) hot rolling the moving strip at casting speed, preferably after holding the cast strip at a high temperature after solidification begins;

(c) coiling and allowing the hot rolled strip to slowly cool; and (d) cold rolling the alloy strip in a cold rolling schedule preferably comprising a flash interannealing step.

In the first step, the melt composition from recycled scrap is adjusted as previously described, and the melt is continuously cast into strip form on a strip casting machine with continuously moving molds in such a way that the cell size or dendrite arm spacing in the region of the surface of the as-cast strip is between 2 to 25 μm, preferably between 5 and 15 μm, and the cell size or dendrite arm spacing in the interior, in the center of the strip, is between 20 and 120 μm, preferably between 50 and 80 μm. For purposes of the present invention, the measurement of the cell size is considered equivalent to the dendrite arm spacing. The relatively small cell size improves the deep-drawing characteristics of the cast strip. The cell size is measured by standard metallographic techniques and is controlled by adjusting the time during casting that the molten alloy spends at the temperature range between the liquidus and solidus temperatures, as described in detail hereinafter. The chill blocks of the apparatus of U.S. Pat. No. 3,774,670, preferred for use with the present process, also contribute to producing a fine grain size. The strip cast with the strip casting machine is preferably 10 to 25 mm thick, in particular 12 to 20 mm thick, in order to ensure optimum use of the available heat and thus a resultant slow rate of solidification. It has also been found to be particularly favorable to keep the width of the cast strip within a range of 500 to 2000 mm, in particular within 800 to 1800 mm.

After solidification begins, the cast strip is preferably held for 2 to 15 minutes at a temperature between 400° C. and the liquidus temperature, which is approximately 600° C.

It is of further advantage if the cast strip, after the start of solidification, is kept for 10 to 50 seconds at an initial higher temperature between 500° C. and the temperature for that particular composition at which solidification begins during cooling, i.e. the liquidus temperature. The high temperature holding of the cast strip may take place with or without the addition of heat to the strip. The high temperature holding takes place as the strip is cast and moves in catenary fashion from the caster to the hot mill. The hot mill is located downstream of the caster a distance sufficient to provide the described holding times.

As a result of the relatively slow solidification rate achieved by the present process, fluctuations associated with casting can be eliminated to a large extent, so that the normal homogenization treatment used in conventional processes may be omitted. Furthermore, there is an optimum distribution of the insoluble heterogeneities, a feature which is favorable in connection with the cold rolling carried out later.

As a result of the relatively long time the solidified strip spends at high temperature, the heat contained in the strip from casting promotes diffusion controlled processes in the structure such as spheroidization and rounding of heterogeneities, equalization of microsegregation (coring), and transformation of non-equilibrium phases to equilibrium phases.

On cooling from the liquid state there are two important temperature ranges, namely:

(a) the temperature range between the liquidus and the solidus, $\Delta T_{LS}$, and (b) the temperature range $\Delta T_{S,S\text{-}100}$ between the solidus and a temperature about 100° C. lower than the solidus.

The time taken to cool through the range $\Delta T_{LS}$ controls the average secondary dendrite arm spacing, or the cell size. On the other hand the time spent in the region $\Delta T_{S,S\text{-}100}$ control changes in the structure detailed above.

In the following table the length of time spent in each of these temperature ranges has been estimated roughly from measurements of the cell size.

TABLE IV

| Sample | Cell Size (μm) | $^t\Delta T_{LS}$ (sec) | $^t\Delta T_{S,S\text{-}100}$ (sec) |
|---|---|---|---|
| Surface of strip cast in accordance with the present process | 15 | 5 | 120 |
| Center of strip cast in accordance with the present process | 50 | 20 | 120 |
| casting rolls, surface | 5 | 0.5 | 0.5 |
| casting rolls, center | 7 | 1 | 0.5 |
| Direct chill cast, surface (scalped) | 30 | 15 | 5 |
| Direct chill cast, center | 70 | 80 | 15 |

According to Table IV the strip cast in accordance with the present process spends much longer in a temperature range where diffusion controlled transformations are possible than is the case with conventional direct chill casting and with strip casting using caster rolls. For this reason the transformations involved have progressed much more in the structure of such strip than in structures produced by conventional direct chill casting. The strip cast in accordance with the process of the invention has undergone a larger amount of homogenization than roll cast or direct chill cast products.

The diffusion events which lead to the above mentioned transformations are dependent on the temperature T via the Boltzmann factor $$f = C \cdot exp\ (E/RT)$$

where the activation energy E is 35–40 kcal/g mol, and R is the universal gas constant $= 1{,}986.10^{-3}$ kcal/g mol.-deg. According to this, the rate of transformation increases by a factor of ten at the temperature $T_S$ compared with the rate at temperature $T_{S\text{-}100}$.

At the surface of the as-cast strip in particular, the diffusion controlled events affecting the equalization of concentration differences may be especially far advanced, as these events proceed more rapidly with finer cell structure. This distinguishes the fine cellular structure of the strip cast in accordance with the present process from larger celled structures associated with other strip casting processes.

After the casting and high temperature holding steps, the cast strip is hot rolled continuously at the casting speed to at least a 70% reduction, with additional heat if desired being supplied to it, starting at a temperature of at least 300° C. and the non-equlibrium solidus temperature, whereby the temperture of the strip at the start of the hot rolling is between the non-equilibrium solidus temperature and a temperature 150° C. below the non-equilibrium solidus temperature, and the temperature of the strip at the end of the hot rolling is at least 280° C. Only an amount of hot forming of at least 70%, at the highest starting temperature possible consistent with the above described holding times, can guarantee the same favorable qualities in the strip as can be achieved with conventional methods. It has been found to be particularly advantageous to ensure a starting temperature of about 490° C. and a finish temperature of at least 280° C., preferably at least 300° C. The initial hot rolling temperature is preferably above 440° C. Especially preferred is a starting temperature above 490° C.

After the strip has been hot rolled, it is coiled and allowed to cool in still air at ambient temperature. The heat stored in the hot coils allows precipitation of the intermetallic phases, which precipitate out slowly, and, at the same time, it brings about some softening, which is favorable for the subsequent cold rolling. There are also signs, even though only slight, that recrystallization occurs in this stage of the process, which, due to a reduction in the amount of rolling texture, has a favorable effect especially in reducing the earing at 45° to the rolling direction, when processing the strip into cans.

After cooling, the strip is cold rolled to final gauge, preferably 0.26–0.34 mm for can ends and bodies, respectively. The cold rolling schedules described above for conventionally cast ingots may be followed with strip cast alloy as well. Alternatively, the strip is first cold rolled in a first series of passes which produce an intermediate gauge with a reduction in thickness of at least 50%, preferably at least 65%.

It has been found particularly advantageous to introduce an intermediate anneal at 350° to 500° C. after reduction to the intermediate gauge. In the production of sheet suitable for manufacturing drawn-and-ironed can bodies, the reduction after intermediate anneal is at most 75%, preferably 40 to 60%. It is to be remembered, however, that an important aspect of the present invention resides in the identity of composition and fabrication processes for both can bodies and can ends, save for the differing cold rolling schedules designed to produce harder sheet for ends. The duration of the intermediate anneal is to advantage at most 90 seconds, including heating up, holding at temperature and cooling down. It has been found to be of further advantage in the intermediate anneal to heat the strip up to the heat treatment temperature within 30 seconds at most, preferably within 4 to 15 seconds. Likewise, it has been found favorable to cool the strip after the intermediate anneal to around room temperature within 25 seconds at most, preferably within 3 to 15 seconds.

As a result of this flash intermediate anneal, in contrast to normal intermediate anneals with slow heating up, slow cooling down, and long holding times, the rolling texture of the cold rolled strip is suppressed to a greater extent but the strength is lowered to a lesser degree.

Due to those results, the second series of cold rolling passes, which is aimed at producing the desired final strength in the strip lead to a less pronounced rolling texture and can also be carried out with a lower degree of cold working, which further diminishes the amount of rolling texture in the final strip. A less pronounced rolling texture results in a smaller amount of earing at 45° to the rolling direction.

The time and temperature for the intermediate anneal are, within the given range, interdependent approximately as given by the equation of the type $$\ln t = A/T - C$$

where t is the time in seconds, T is the temperature in °K., and A and C are constants, i.e. at higher temperature the corresponding time required is shorter.

The following example illustrates the present process as carried out with conventional annealing:

EXAMPLE I

An aluminum alloy in accordance with the present invention, designated "A", consisted essentially of: magnesium, 1.86%, manganese, 0.66%, copper, 0.04%, silicon 0.23%; and iron 0.39%. A 3004 can alloy, designated "B", consisted essentially of magnesium 0.9%, manganese 0.96%, copper 0.09%, silicon 0.18%, and iron 0.58%. These alloys were cast into 20 mm thick strips in a strip casting machine, hot rolled in line with the caster in two passes and then coiled while hot. The first pass reducing the strip from 20 mm to 6 mm was made at a temperature of 550° to 420° C., and the second pass took place from 360° to 320° C., reducing the strip from 6 mm to 3 mm.

The subsequent cold rolling of strip A reduced the 3 mm strip to 0.60 mm, strip B from 3 mm to 1.15 mm. After an intermediate anneal of 1 hour at 420° C. strips A and B were cold rolled further to 0.34 mm.

The cold rolling schedules for strips A and B were chosen in such a way that at the same end thickness of 0.34 mm both strips exhibited the same strength values. After rolling to end thickness, strip A showed a yield strength of 261 MPa with 1.6% earing, while strip B showed a yield strength of 261 MPa with 3.0% earing.

The following example demonstrates that the present alloy, when flash annealed according to the present process, can produce lower earing and higher strength, when compared to a conventional can body alloy which has been conventionally annealed.

EXAMPLE II

The preceeding alloys were processed as above to an initial cold rolling gauge of 3 mm. At that point their strengths were similar. Strip B was subsequently cold rolled from 3 mm to 1.05 mm, and strip A from 3 mm to 0.65 mm, after which both strips were given an intermediate anneal at 425° C. before being cold rolled further to 0.34 mm. The intermediate anneal was carried out in two different ways, namely (a) conventionally with 1 hour at 425° C., with approximately 10 hours heating up to temperature and cooling over an interval of approximately 3 hours;

(b) the brief heat treatment in accordance with the invention i.e. 10 seconds at 425° C., and 15 seconds required for heating up and 15 seconds for cooling down.

Both treatments (a) and (b) produced complete recrystallization in the strip.

The following yield strength and earing values were obtained:

TABLE V

| Strip | Intermediate Anneal | Yield Strength: Before Cold Rolling to 0.34 mm | Yield Strength: After Cold Rolling to 0.34 mm | Earing |
|---|---|---|---|---|
| A | (a) | 88 MPa | 266 MPa | 1.8% |
| | (b) | 104 MPa | 278 MPa | 1.2% |
| B | (a) | 71 MPa | 261 MPa | 3.0% |
| | (b) | 87 MPa | 274 MPa | 2.4% |

It can be seen clearly from Table V that the brief heat treatment of the invention produces lower earing values in spite of the higher strength, than does the conventional intermediate anneal. If the cold rolling schedule is designed such that, after the flash annealing the same final strength is obtained as after the conventional intermediate anneal, then the reduction in the earing by the brief heat treatment of the invention is even more striking, as shown by Example I.

EXAMPLE III

The same alloy as designated alloy A in Example I was, as described in Example I, produced as 3 mm thick hot rolled strip.

After cold rolling from 3 mm to 0.65 mm, three different intermediate anneals were employed, after which the material from all three treatments was cold rolled to final thickness with a 85% reduction in thickness as would be carried out in the production of end stock. The strength values YS and UTS were found to be 335 and 340 MPa respectively.

Finally, in order to simulate coating and curing, the material was given a treatment of 8 minutes at 190° C. which produces a partial softening as described hereinafter.

The strength loss after this partial softening treatment is given in Table VI together with details of the corresponding intermediate anneal.

TABLE VI

| Intermediate Anneal | | 350° C./20 s | 425° C./20 s | 425° C./1 h |
|---|---|---|---|---|
| Loss of Strength | ΔYS | 18 MPa | 40 MPa | 55 MPa |
| | ΔUTS | 0 MPa | 15 MPa | 40 MPa |

It can be seen from Table VI that the brief heat treatments of 20 s at 350° C. and 20 s at 425° C. cause a much smaller loss of strength then the conventional intermediate anneal of 1 hour at 425° C. in the course of the later partial softening treatment.

CAN BODY MANUFACTURING

The can stock fabricated by the procedures described above is formed into one piece, deep-drawn can bodies. The sheet is first cut into circular blanks which are drawn into shallow cups by stretching the metal over a punch and through a die. The lip of the cup thus formed preferably lies in a circular plane. The extent to which the lip of the cup is not planar is referred to in the art as "earing." The alloy of the present invention exhibits up to 50% less earing at 45° to the rolling direction than 3004 can body stock in a 32–40% initial draw. As shown in Table V above, earing values of 2% or less can easily be obtained with the present alloy. Percent draw is calculated by subtracting the diameter of the cup from the diameter of the blank and dividing by the diameter of the blank. The shallow drawn cups are then redrawn and ironed in a draw-and-iron process, wherein the cup is forced through a series of dies with circular bores of diminishing diameters. The dies produce an ironing effect which lengthens the sidewalls of the can and permits the manufacture of can bodies having sidewalls thinner than their bottoms. If the metal being formed is too soft, it will tend to build up on the working surfaces of the ironing dies, a process referred to as "galling" and which interferes with the drawing-and-ironing operation and results in metal failure and process interruption. The present alloy exhibits less galling and tool wear than conventional can body alloys.

CAN END MANUFACTURING

In the manufacture of can ends, the end stock is levelled, cleaned, conversion coated, and primed, if desired. It is then coated as described below. The coated stock is fed to a press to form a shell, which is a shallow drawn flanged disc. The shell is then fed into a conversion press for forming an easy opening end where the end is scored and an integral rivet is formed. A tab can be made separately in a tab press and fed separately into the conversion press to be riveted on the end, or the tab can be made in the conversion press from a separate strip and the tabs and ends may be formed and joined in the conversion press. While tabs are frequently made from other alloys than used in the can ends, the alloy of the present invention has sufficient formability for use in tab manufacture. A further description of manufacturing can bodies, ends and tabs is found in Setzer et al., U.S. Pat. No. 3,787,248, and in Herrmann, U.S Pat. No. 3,888,199 which descriptions are incorporated herein by reference.

COATING

Figure 3:
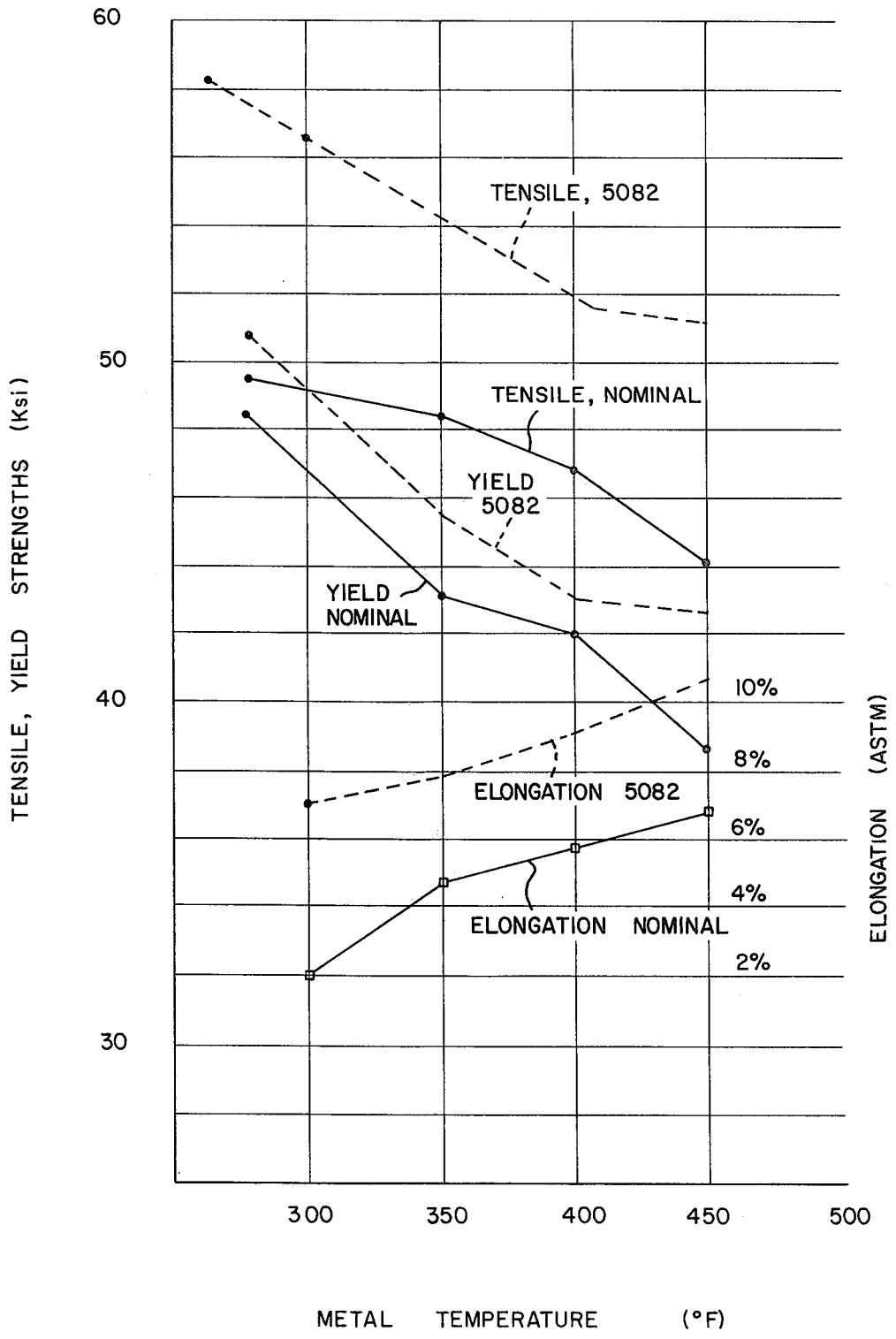
FIG. 3 is a graph showing the thermal response of the alloy used in the present invention.

Both end stock and drawn-and-ironed can bodies are commonly coated with a polymeric layer to prevent direct contact between the alloy container and the material contained therein. The coating is typically an epoxy or vinyl polymer which is applied to the metal in a powder emulsion, or solvent solution form and subsequently heat cured to form a cross-linked protective layer. The coating is typically cured at an elevated temperature of 175°–220° C. for 5 to 20 seconds. This heat treatment tends to weaken most aluminum alloys. Referring now to FIG. 3, the thermal responses of the present alloy and 5082 are shown for 85% cold work reduction at a 4 minute soak time. The curves are similar for all soak times tested. The tensile strength of the present alloy at 190° C. falls from 49 ksi (340 MPa) to 47.5 ksi (330 MPa), while the tensile strength of 5082 coated end stock falls from 58.5 ksi to 54 ksi (400–370 MPa). The thermal response for yield strengths shows a drop of 51–44 ksi for 5082 and 48–42 ksi (33–29 MPa) for the present alloy. In another test of a continuously cast strip of 5182 for 8 min. at 190° C., the yield strength was found to drop from 340 MPa to 305 MPa for a composition according to the present invention and from 360 MPa to 290 MPa for 5182.

These figures show that the heating used to bake and cure the coatings typically applied to aluminum containers will weaken conventional end stock to a greater degree than the present alloy. Thus, the present alloy may be fabricated to a lesser "as rolled", or pre-coating, strength than other alloys and still retain sufficient strength in the final product. The elongation curves demonstrate that the present alloy increases in elongation during a given bake to a greater extent than does 5082. Thus, after a given bake, the present alloy improves in formability to a greater extent than other alloys.

While the present invention has been particularly described with regard to illustrative and presently preferred embodiments thereof, modifications of the embodiments described herein may be variously carried out. Thus it is intended that the appended claims be construed to include alternative embodiments of the inventive concepts disclosed herein, except insofar as limited by the prior art.

What is claimed is:

1. A process of manufacturing comprising:

(a) providing a supply of aluminum alloy consumer scrap;

(b) melting said aluminum alloy consumer scrap in a heated furnace to form a melt composition;

(c) adjusting the melt composition to a composition within a range of 1.3–2.5% magnesium and 0.4–1.0% maganese, with between 0.15–1.0% silicon, wherein said manganese and magnesium are present in a total concentration of 2.0–3.3% and a ratio of magnesium to manganese of between 1.4:1 and 4.4:1 from about 0.1% to 0.9% iron and from about 0.05% to 0.4% copper;

(d) treating the composition to remove materials which would impair casting and quality of finished sheet;

(e) casting the composition; and (f) fabricating the composition into aluminum alloy sheet suitable for manufacturing aluminum containers.

2. The process of claim 1 wherein said adjusting comprises the addition of at least 40% scrap.

3. The process of claim 1 wherein said adjusting comprises the addition of less than 25% unalloyed aluminum.

4. The process of claim 1 further comprising the steps of:

reducing the consumer scrap to shreds; and delacquering said consumer scrap at a pyrolysis temperature in a delacquering furnace.

5. The process of claim 4 wherein said delacquering takes place at 480°–540° C.

6. The process of claim 1 wherein said treating comprises bubbling a gaseous mixture through the remelt composition.

7. The process of claim 1 wherein said casting is carried out at a rate exceeding 110 kg per minute.

8. The process of claim 1 wherein said fabricating comprises a first cold rolling schedule for producing can body stock and a second cold rolling schedule for producing can end stock.

9. The process of claim 8 further comprising the steps of:

drawing-and-ironing a can body from said can body stock; and manufacturing a can end for said can body from said can end stock.

10. The process of claim 1 further comprising the steps of coating said aluminum alloy sheet, and the step of heating the coated aluminum alloy.

11. The process of claim 10 wherein said heating comprises age hardening the alloy.

12. A process for manufacturing aluminum sheet stock which can subsequently be converted into container components comprising the steps of:

(a) melting aluminum scrap derived in part from scrap aluminum containers;

(b) adjusting the composition of the melt to obtain a casting composition having by weight from about 1.3% to about 2.5% magnesium and from about 0.4% to about 1.0% manganese, between 0.15–1.0% silicon wherein said manganese and said magnesium are present in total in an amount equal to about 2.0% to 3.3% by weight and where the ratio of the amount of magnesium to manganese is between about 1.4 to 1 and 4.4 and 1 from about 0.1% to 0.9% iron and from about 0.05% to 0.4% copper; casting the adjusted melt composition and fabricating the composition into aluminum alloy sheet having the desired characteristics for subsequent manufacture into aluminum container components and containers.

13. The process of claim 12 wherein said scrap aluminum containers comprise at least 40% by weight of the melt.

14. The process of claim 13 wherein said scrap aluminum containers includes having a mixture of different aluminum container components.

15. The process of claim 12 wherein the adjustment of the melt composition includes providing the composition with from 0.15% to 1.0% by weight of silicon, from 0.1% to 0.9% by weight of iron and from 0.05% to 0.4% by weight of copper.

16. A method of recycling aluminum containers comprising the steps of melting scrap aluminum consisting in part of scrap aluminum containers to form a melt, adjusting the composition of the melt to provide an aluminum alloy composition containing from about 1.3% to 2.5% by weight of magnesium; from about 0.4% to 1.0% by weight of manganese, said magnesium and manganese together totaling from 2.0% to about 3.3% by weight of the composition while establishing a ratio of magnesium to manganese of about 1.4 to about 4.4 to 1; and said melt additionally comprising from about 0.15% to 1.0% silicon; from about 0.1% to 0.9% iron and from about 0.05% to 0.4% copper;

casting and rolling the adjusted melt composition to form aluminum alloy sheet stock having the physical characteristics necessary for subsequent manufacture into aluminum containers and container components which can be reused to make sheet stock of the same composition by the reapplication of this method of recycling.

17. The method of claim 16 wherein the scrap aluminum containers comprises container components of the same composition as the resultant sheet stock of the method, in combination with containers and container components of different compositions.

* * * * *